US008546050B2

(12) United States Patent
Maruyama et al.

(10) Patent No.: US 8,546,050 B2
(45) Date of Patent: Oct. 1, 2013

(54) ELECTROPHOTOGRAPHIC PHOTOSENSITIVE MEMBER, PROCESS CARTRIDGE, AND ELECTROPHOTOGRAPHIC APPARATUS

(75) Inventors: Akihiro Maruyama, Mishima (JP); Kunihiko Sekido, Numazu (JP); Michiyo Sekiya, Mishima (JP); Hideaki Nagasaka, Suntou-gun (JP); Shinji Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 13/182,192

(22) Filed: Jul. 13, 2011

(65) Prior Publication Data

US 2012/0052423 A1 Mar. 1, 2012

(30) Foreign Application Priority Data

Aug. 27, 2010 (JP) ..... 2010-191210

(51) Int. Cl.
*G03G 5/14* (2006.01)
*G03G 5/05* (2006.01)

(52) U.S. Cl.
CPC ..... *G03G 5/0521* (2013.01); *G03G 5/142* (2013.01)
USPC ..... 430/60; 430/63; 430/65; 399/159

(58) Field of Classification Search
USPC ..... 430/60, 63, 65; 399/159
See application file for complete search history.

(56) References Cited

U.S. PATENT DOCUMENTS 5,455,135 A 10/1995 Maruyama et al.
5,604,061 A 2/1997 Sekido et al.
5,693,443 A 12/1997 Nakamura et al.
6,110,628 A 8/2000 Sekiya et al.
6,228,546 B1 5/2001 Kashizaki et al.

(Continued)

FOREIGN PATENT DOCUMENTS

CN 102063026 A 5/2011
EP 1 813 991 A1 8/2007

(Continued)

OTHER PUBLICATIONS

English language machine translation of JP 2003-336043 (Nov. 2003).*

(Continued)

*Primary Examiner* — Christopher Rodee
(74) *Attorney, Agent, or Firm* — Fitzpatrick, Cella, Harper and Scinto

(57) ABSTRACT

The present invention is an electrophotographic photosensitive member including a conductive support, an intermediate layer which is placed on the conductive support, and a photosensitive layer which is placed on the intermediate layer, wherein the intermediate layer comprises a metal-oxide particle and a compound having a structure represented by the following formula (1):

(1)

6 Claims, 3 Drawing Sheets

(56) References Cited

U.S. PATENT DOCUMENTS

| | | | | |
|---|---|---|---|---|
| 6,248,490 | B1 | 6/2001 | Suzuki et al. | |
| 6,335,133 | B1 | 1/2002 | Nagasaka | |
| 6,372,397 | B1 | 4/2002 | Maruyama et al. | |
| 6,432,603 | B1 | 8/2002 | Kimura et al. | |
| 6,436,597 | B2 | 8/2002 | Maruyama et al. | |
| 6,664,014 | B1 | 12/2003 | Kikuchi et al. | |
| 6,750,288 | B2 | 6/2004 | Pradel | |
| 6,831,131 | B2 | 12/2004 | Bouilloux et al. | |
| 6,953,647 | B2 | 10/2005 | Kimura et al. | |
| 7,141,341 | B2 | 11/2006 | Sekido et al. | |
| 7,229,729 | B2 | 6/2007 | Shida et al. | |
| 7,378,205 | B2 | 5/2008 | Sekiya et al. | |
| 7,498,108 | B2 * | 3/2009 | Wu et al. | 430/59.1 |
| 7,498,109 | B2 * | 3/2009 | Wu et al. | 430/60 |
| 7,732,113 | B2 | 6/2010 | Nakamura et al. | |
| 2003/0118927 | A1 * | 6/2003 | Nakamura et al. | 430/65 |
| 2005/0037274 | A1 | 2/2005 | Shida et al. | |
| 2005/0207788 | A1 * | 9/2005 | Bandou et al. | 399/159 |
| 2009/0269103 | A1 | 10/2009 | Inaba et al. | |
| 2011/0006291 | A1 | 1/2011 | Yokoyama et al. | |
| 2011/0104597 | A1 | 5/2011 | Nagasaka et al. | |
| 2011/0104601 | A1 | 5/2011 | Takagi et al. | |
| 2011/0117483 | A1 | 5/2011 | Ishiduka et al. | |
| 2011/0143273 | A1 | 6/2011 | Sekido et al. | |
| 2011/0268472 | A1 | 11/2011 | Sekido et al. | |

FOREIGN PATENT DOCUMENTS

| | | | | |
|---|---|---|---|---|
| JP | 3-13957 | A | | 1/1991 |
| JP | 2003-105145 | A | | 4/2003 |
| JP | 2003-147028 | A | | 5/2003 |
| JP | 2003336043 | A | * | 11/2003 |
| JP | 2005-37480 | A | | 2/2005 |
| JP | 2005-292821 | A | | 10/2005 |
| JP | 2006064954 | A | * | 3/2006 |
| JP | 2008-162979 | A | | 7/2008 |
| JP | 2008-299020 | A | | 12/2008 |
| WO | 2009/096549 | A1 | | 8/2009 |

OTHER PUBLICATIONS

English language machine translation of JP 2006-064954 (Mar. 2006).*

European Search Report dated Nov. 18, 2011 in European Application No. 11174495.9.

Chinese Office Action dated Jul. 24, 2012 in Chinese Application No. 201110243820.X.

"Shin koubunshi Jikkengaku 2: koubunshi no Gousei Hannou (1) (New Polymer Experimental Study 2: Synthesis and reaction of Polymer (1))", Kyoritsu Shuppan Co., Ltd., 1995, Chapter 4, pp. 277-364.

Mutai, et al., "Phenyl-substituted 2,2':6',2"-terpyridine as a new series of fluorescent compounds—their photophysical properties and fluorescence tuning", J. Chem. Soc., Perkin Trans. 2, 2001, pp. 1045-1050.

Zhou, et al., "Fullerene Polypyridine Ligands: Synthesis, Ruthenium Complexes, and Electrochemical and Photophysical Properties", Chem. Eur. J., vol. 12, 2006, pp. 4241-4248.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge, and an electrophotographic apparatus.

2. Description of the Related Art

In the field of electrophotography, recently, high quality images such as color images have been formed. Formation of such color images increases halftone images and solid images, leading to a demand for improved image quality. For example, in the case where a reversal development type electrophotographic apparatus is used to form an image in which a portion in one image irradiated with light becomes a halftone image in the next rotation, a phenomenon (positive ghost phenomenon) is likely to occur, i.e., only the density of the portion irradiated with the light is increased.

One type of the electrophotographic photosensitive member includes a charge-generating layer comprising a charge-generating substance (organic photoconductive substance) and a hole-transporting layer comprising a hole-transporting substance, the layers being provided on a conductive support. Other type of the electrophotographic photosensitive member includes a single layer photosensitive layer comprising a charge-generating substance and a hole-transporting substance and provided on a conductive support.

Unfortunately, if only the photosensitive layer is provided on the conductive support, hole injection may be caused from the conductive support to the photosensitive layer at the time of applying voltage to the electrophotographic photosensitive member. Hole injection from the conductive support to the photosensitive layer causes image defects of black dots (black spots) to remarkably reduce the image quality.

In order to suppress production of the black spots, there is a method in which the so-called intermediate layer having electrical blocking function is provided between the photosensitive layer and the conductive support.

On the other hand, if the electrical resistance of the intermediate layer is excessively high, electrons produced in the charge-generating layer stagnate within the photosensitive layer to cause the ghost phenomenon. Accordingly, the electrical resistance value of the intermediate layer needs to be small to some extent, and both improvement of the ghost and suppression of the black spots are required.

Then, there is a method in which a metal-oxide particle is included in the intermediate layer in order to suppress stagnation of the electrons within the photosensitive layer and improve the ghost in the electrophotographic photosensitive member. Unfortunately, hole injection from the conductive support to the photosensitive layer is undesirably promoted to produce the black spots while the ghost is well improved by reduction in the electrical resistance value of the intermediate layer.

Then, in order to improve the ghost and suppress the black spots, Japanese Patent Application Laid-Open No. H03-013957 proposes that a metal-oxide particle surface-treated with an organic titanium compound is included in the intermediate layer. Moreover, Japanese Patent Application Laid-Open No. 2005-292821 proposes that a metal-oxide particle surface-treated with a reactive organic compound containing sulfur atoms is included in the intermediate layer. Further, Japanese Patent Application Laid-Open No. 2005-037480 proposes that a metal-oxide particle surface-treated with a reactive low molecular organic silicon compound is included in the intermediate layer. Japanese Patent Application Laid-Open No. 2008-299020 proposes that a metal-oxide particle surface-treated with a reactive polymeric organic silicon compound is included in the intermediate layer.

However, any of the intermediate layers each including the metal-oxide particle subjected to the corresponding surface treatment cannot improve the ghost and suppress the black spots at a high level.

SUMMARY OF THE INVENTION

An object of the present invention is to provide an electrophotographic photosensitive member comprising a conductive support, an intermediate layer which is placed on the conductive support, and a photosensitive layer which is placed on the intermediate layer wherein a ghost is improved and black spots are suppressed at a high level. Moreover, other object of the present invention is to provide a process cartridge and an electrophotographic apparatus having the electrophotographic photosensitive member.

The objects are achieved by the present invention.

Namely, the present invention provides an electrophotographic photosensitive member comprising a conductive support, an intermediate layer which is placed on the conductive support, and a photosensitive layer which is placed on the intermediate layer, and comprises a charge-generating substance and a hole-transporting substance; wherein the intermediate layer comprises a metal-oxide particle and a compound having a structure represented by the following formula (1):

(1)

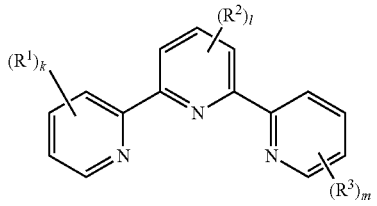

wherein, in the formula (1), $R^1$ and $R^3$ each independently represents a halogen atom, an alkyl group having 1 to 6 carbon atoms, an acetyl group, an alkyl halide group having 1 to 6 carbon atoms, or $COOR^4$; $R^4$ represents an alkyl group having 1 to 6 carbon atoms; k, l, and m each independently represents integer number 0 to 3; $R^2$ represents a halogen atom, an alkyl group having 1 to 6 carbon atoms, an acetyl group, $COOR^8$, an alkyl halide group having 1 to 6 carbon atoms, or an univalent group having a structure represented by the following formula (2) or the following formula (3); $R^8$ represents an alkyl group having 1 to 6 carbon atoms:

(2)

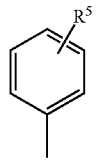

wherein, in the formula (2), $R^5$ represents a halogen atom, an alkyl group having 1 to 6 carbon atoms, an acetyl group, an alkyl halide group having 1 to 6 carbon atoms, or $COOR^9$; and $R^9$ represents an alkyl group having 1 to 6 carbon atoms:

(3)

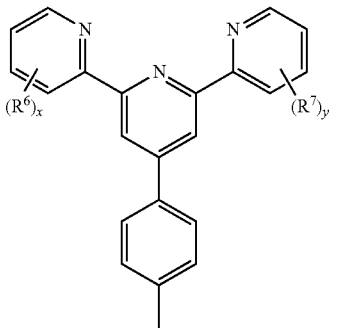

wherein in the formula (3), $R^6$ and $R^7$ each independently represents a halogen atom, an alkyl group having 1 to 6 carbon atoms, an acetyl group, an alkyl halide group having 1 to 6 carbon atoms, or $COOR^{10}$; $R1^0$ represents an alkyl group having 1 to 6 carbon atoms, and x and y each independently represents integer number 0 to 3.

Furthermore the present invention provides a process cartridge detachably attachable to a main body of an electrophotographic apparatus, wherein the process cartridge integrally supports the electrophotographic photosensitive member; and at least one device selected from the group consisting of a charging device, a developing device, a transferring device, and a cleaning device.

Furthermore the present invention provides an electrophotographic apparatus comprising an electrophotographic photosensitive member, a charging device, an exposing device, a developing device, and a transferring device.

According to the present invention, the metal-oxide particle and the compound having a structure represented by the formula (1) are comprised in an intermediate layer of an electrophotographic photosensitive member to provide an electrophotographic photosensitive member in which a ghost is improved and black spots are suppressed at a high level. Moreover, according to the present invention, a process cartridge and an electrophotographic apparatus having the electrophotographic photosensitive member can be provided.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An electrophotographic photosensitive member used in the present invention has a layer structure of a conductive support, an intermediate layer which is placed on the conductive support, and a photosensitive layer which is placed on the intermediate layer.

In the present invention, in order to cover defects of the conductive support or suppress moire patterns, a conductive layer including a conductive particle may be provided between the conductive support and the intermediate layer.

Figure 2:
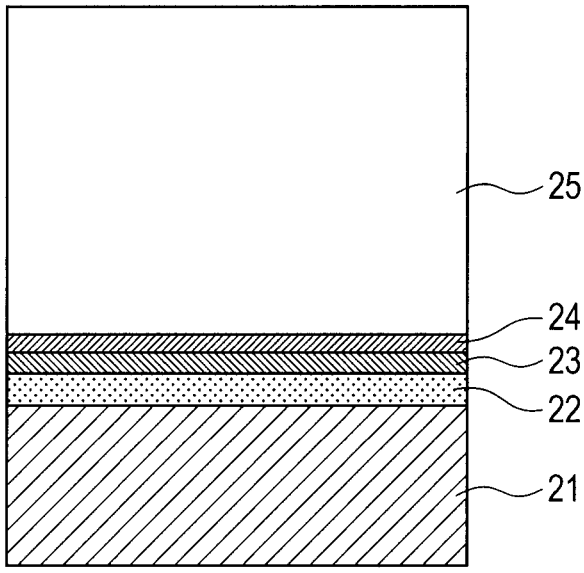
FIG. 2 is a drawing for illustrating a layer structure of the electrophotographic photosensitive member according to the present invention.

Moreover, examples of the photosensitive layer include a single layer photosensitive layer comprising a hole-transporting substance and a charge-generating substance in the same layer, and a laminated (function-separated) photosensitive layer in which a charge-generating layer comprising a charge-generating substance is separated from a hole-transporting layer comprising a hole-transporting substance. In the present invention, the laminated (function-separated) photosensitive layer is preferred. FIG. 2 schematically shows a preferred configuration of electrophotographic photosensitive member in the present invention. In the electrophotographic photosensitive member shown in FIG. 2, a conductive layer 22 described later is laminated on a conductive support 21. An intermediate layer 23 is placed on the conductive layer. A charge-generating layer 24 is placed on the intermediate layer. A hole-transporting layer 25 is placed on the charge-generating layer. When necessary, a protective layer may be provided on the hole-transporting layer.

The intermediate layer is provided between the conductive support and the photosensitive layer in order to suppress hole injection from the conductive support to the photosensitive layer. The intermediate layer can improve the ghost and suppress the black spots at a high level if the intermediate layer comprises a metal-oxide particle and a compound having a structure represented by the formula (1).

The present inventors presume the reason that the electrophotographic photosensitive member according the present invention has such a high effect as follows.

In the present invention, the intermediate layer comprises a metal-oxide particle. This leads to smooth movement of charges in the intermediate layer to suppress stagnation of electrons and improve the ghost properties. If the intermediate layer comprises a metal-oxide particle, however, the charges in electrons and holes smoothly move in the intermediate layer. This accelerates hole injection from the conductive support to the photosensitive layer. Thereby, a potential of the surface of a photosensitive member is locally reduced to produce black spots.

A compound having a structure represented by the formula (1) in the present invention (referred to as the compound) has a strong electron attractive nitrogen-containing cyclic structure that is short of electrons. For this reason, the compound has a high affinity with the electron and conversely a low affinity with the hole. Moreover, the compound has such a nitrogen-containing cyclic structure, and it is presumed that the compound interacts with the metal-oxide particle. Interaction of the compound with the metal-oxide particle changes the electron density of nitrogen atoms in three aromatic rings. It is thought that by the change in the electron density of the nitrogen atoms, the compound blocks movement of the charges in the holes; thereby, hole injection from the support to the photosensitive layer is suppressed. With respect to movement of the electrons, it is thought that the compound has a structure of a high affinity with the electrons, and therefore does not inhibit movement of the electrons. It is presumed that as a result, the ghost can be improved and the black spots can be suppressed at a high level.

(Intermediate Layer)

The intermediate layer of the electrophotographic photosensitive member according to the present invention comprises the compound having a structure represented by the formula (1).

(1)

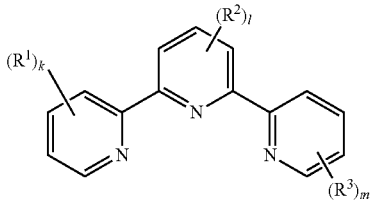

wherein, in the formula (1), $R^1$ and $R^3$ each independently represents a halogen atom, an alkyl group having 1 to 6 carbon atoms, an acetyl group, an alkyl halide group having 1 to 6 carbon atoms, or $COOR^4$; $R^4$ represents an alkyl group having 1 to 6 carbon atoms; k, l, and m each independently represents integer number 0 to 3, $R^2$ represents a halogen atom, an alkyl group having 1 to 6 carbon atoms, an acetyl group, an alkyl halide group having 1 to 6 carbon atoms, $COOR^8$, or an univalent group having a structure represented by the following formula (2) or the following formula (3); $R^8$ represents an alkyl group having 1 to 6 carbon atoms:

(2)

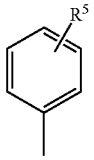

wherein, in the formula (2), $R^5$ represents a halogen atom, an alkyl group having 1 to 6 carbon atoms, an acetyl group, an alkyl halide group having 1 to 6 carbon atoms, or $COOR^9$; and $R^9$ represents an alkyl group having 1 to 6 carbon atoms:

(3)

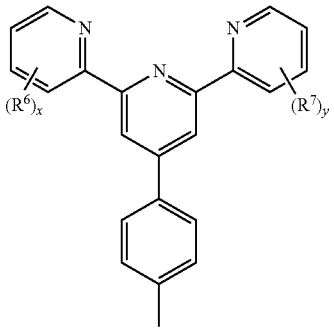

wherein in the formula (3), $R^6$ and $R^7$ each independently represents a halogen atom, an alkyl group having 1 to 6 carbon atoms, an acetyl group, an alkyl halide group having 1 to 6 carbon atoms, or $COOR^{10}$; $R^{10}$ represents an alkyl group having 1 to 6 carbon atoms, and x and y each independently represents integer number 0 to 3.

Hereinafter, Tables 1 to 3 show examples of the compound having a structure represented by the formula (1). These exemplified compounds can be synthesized as described in known examples (J. Chem. Soc., Perkin Tans. 2, 2001, pp. 1045-1050, Chem. Eur. J. 2006, 12, pp. 4241-4248, and Japanese Patent Application Laid-Open No. 2008-162979).

TABLE 1

| Exemplified compounds | |
|---|---|
| No. | Exemplified compounds |
| T-1 | 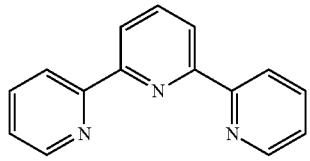 |
| T-2 | 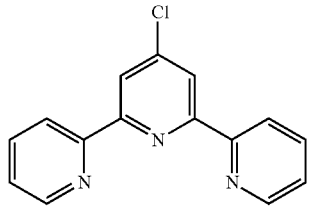 |
| T-3 | 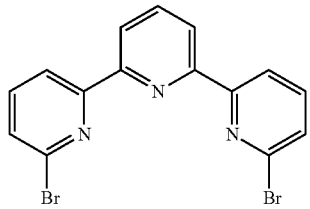 |
| T-4 | 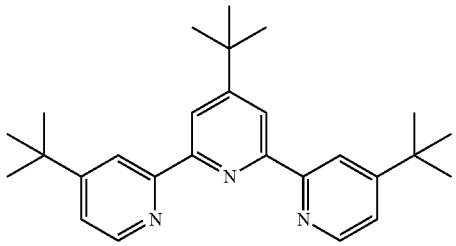 |
| T-5 | 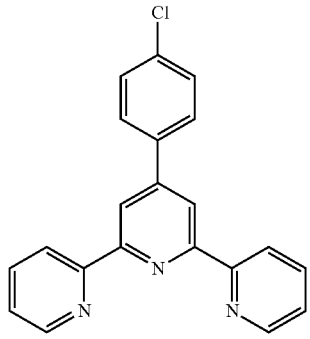 |

TABLE 1-continued
| Exemplified compounds | |
|---|---|
| No. | Exemplified compounds |
| T-6 | 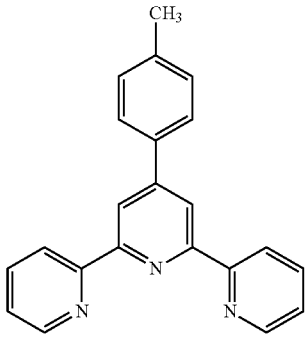 |
| T-7 | 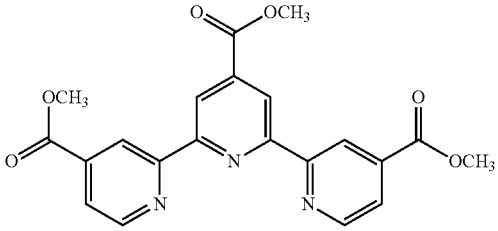 |
| T-8 | 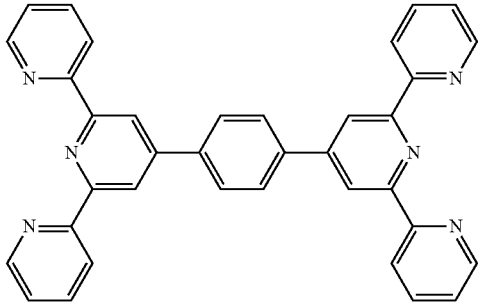 |
| T-9 | 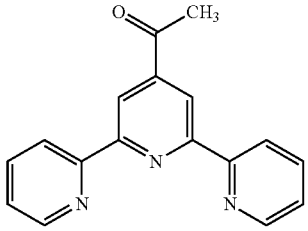 |
| T-10 | 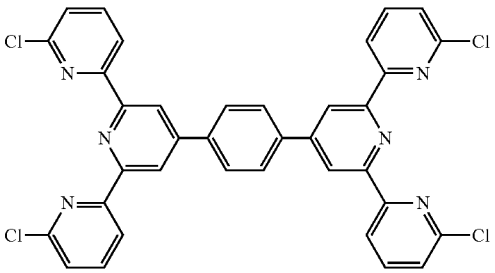 |
TABLE 1-continued
| Exemplified compounds | |
|---|---|
| No. | Exemplified compounds |
| T-11 | 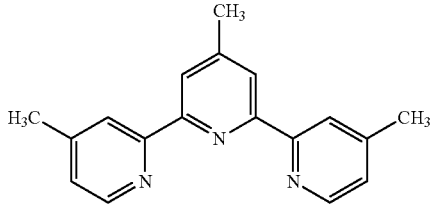 |
| T-12 | 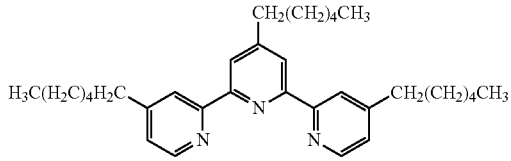 |
TABLE 2
| Exemplified compounds | |
|---|---|
| No. | Exemplified compounds |
| T-13 | 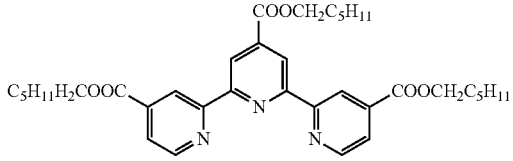 |
| T-14 | 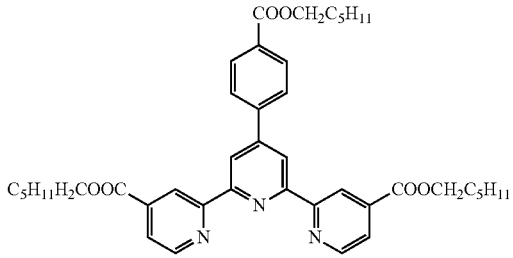 |
| T-15 | 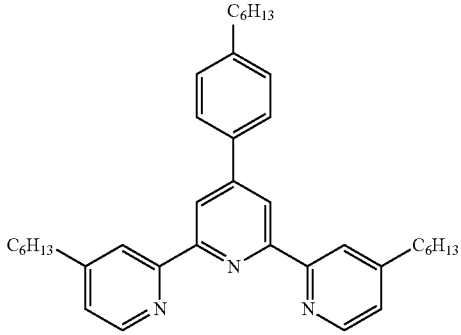 |

TABLE 2-continued
| Exemplified compounds | |
|---|---|
| No. | Exemplified compounds |
| T-16 | 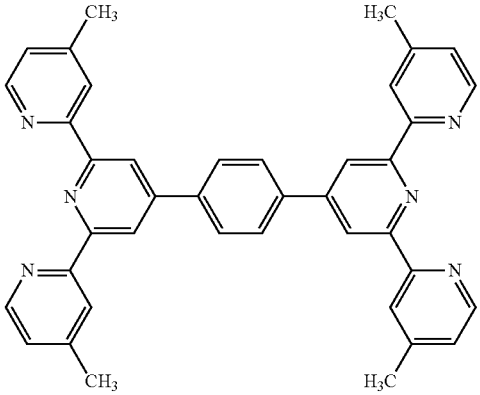 |
| T-17 | 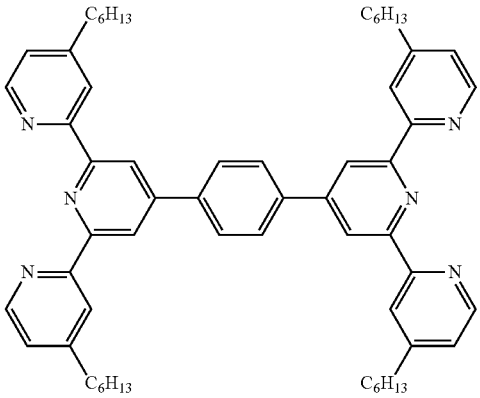 |
TABLE 3
| Exemplified compounds | |
|---|---|
| No. | Exemplified compounds |
| T-18 | 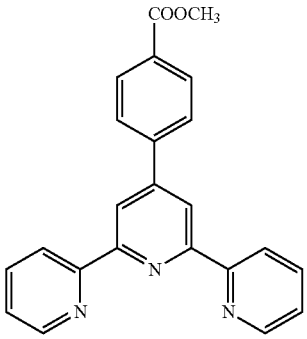 |
TABLE 3-continued
| Exemplified compounds | |
|---|---|
| No. | Exemplified compounds |
| T-19 | 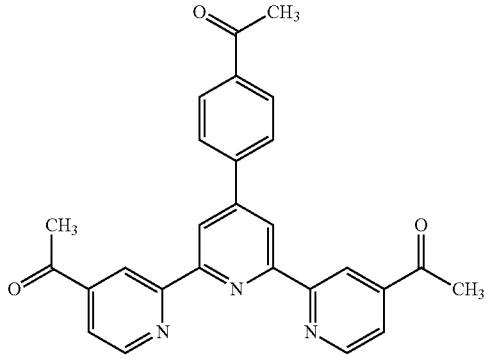 |
| T-20 | 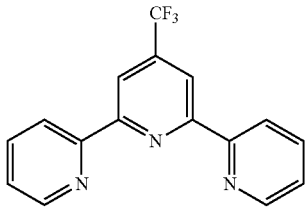 |
| T-21 | 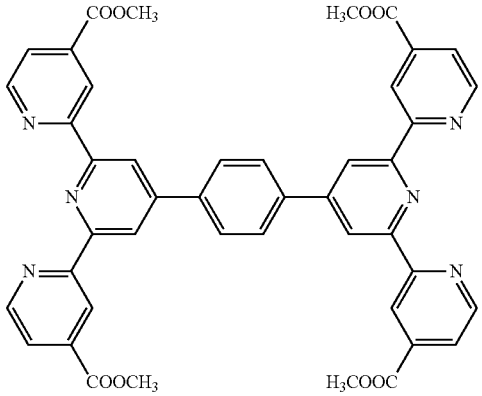 |
| T-22 | 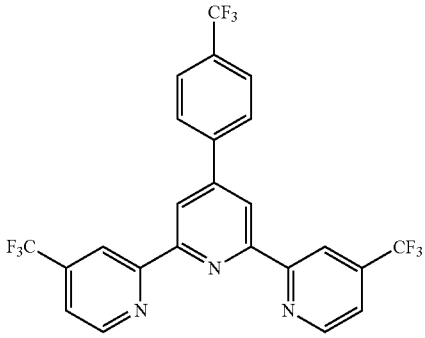 |

TABLE 3-continued

| Exemplified compounds | |
|---|---|
| No. | Exemplified compounds |
| T-23 | 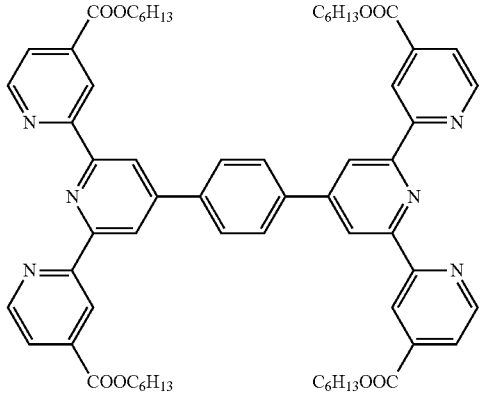 |
| T-24 | 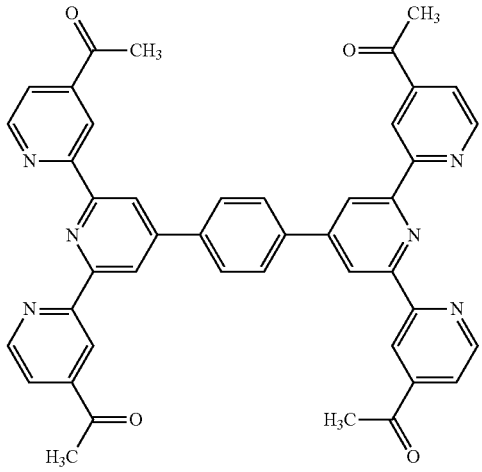 |
| T-25 | 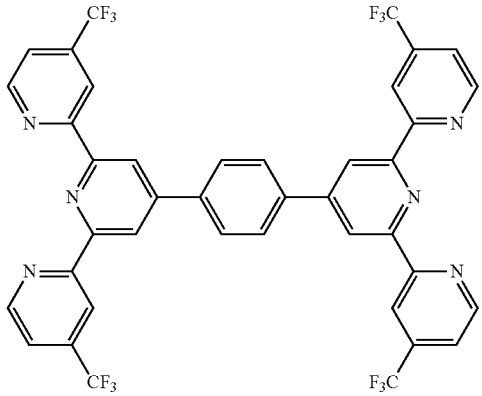 |

Among these, preferred are exemplified compounds represented by (T-1) to (T-9) in Tables 1 to 3.

<Metal-Oxide Particle>

Examples of a preferable metal-oxide particle comprised in the intermediate layer of the electrophotographic photosensitive member according to the present invention include particles of tin oxide ($SnO_2$), titanium oxide ($TiO_2$), zinc oxide (ZnO), aluminum oxide ($Al_2O_3$), zirconium oxide (ZrO), and indium oxide ($In_2O_3$). The metal-oxide particle may be a metal-oxide particle whose surface is treated with a surface treating agent such as aluminum oxide and zirconium oxide. From the viewpoint of an improved the ghost and suppressed the black spots, a more preferable metal-oxide particle is those of tin oxide, titanium oxide, and zinc oxide.

The content of the compound having the structure represented by the formula (1) is preferably not less than 0.1% by mass and not more than 50% by mass, and in specific not less than 0.1% by mass and not more than 25% by mass based on the metal-oxide particle to be included. At a content of not less than 0.1% by mass and not more than 25% by mass, high ghost properties and an effect of suppressing the black spots are obtained.

The number average particle size of the metal-oxide particle is preferably not less than 5 nm and not more than 100 nm.

The number average particle size of the metal oxide in the present invention can be determined by the following method.

Using dynamic light scattering, the particle size of the metal oxide can be measured. Specifically, a measurement solution having a concentration adjusted such that the metal oxide particles may not aggregate to be gelled is prepared. In the present invention, a preferable concentration is approximately 0.5 to 1% by mass based on the disperse medium (measurement solution). The measurement solution is measured by a particle size measuring apparatus (Zetasizer Nano Series, made by Sysmex Corporation) using dynamic light scattering.

Examples of resins used for the intermediate layer of the electrophotographic photosensitive member according to the present invention include phenol resins, epoxy resins, polyurethane resins, polycarbonate resins, polyarylate resins, polyolefin resins, polyester resins, polyamide resins, polyimide resins, polyamidimide resins, polyamic acid, polyethylene resins, polystyrene resins, styrene-acrylic copolymers, acrylic resins, polymethacrylate resins, polyvinyl alcohol resins, polyvinyl acetal resins, polyvinyl butyral resins, polyvinyl formal resins, polyacrylonitrile resins, polyacrylamide resins, acrylonitrile-butadiene copolymers, polyvinyl chloride, vinyl chloride-vinyl acetate copolymers, celluloses, alkyd resins, melamine resins, alkyd-melamine resins, urethane resins, amylose, amylopectin, polysulfone resins, polyethersulfone resins, and silicone resins. Preferably, examples thereof include polyolefin resins, polyamides, alkyd-melamine resins, and urethane resins. Alternatively, these resins may be used as a copolymer. These resins can be used alone, or mixed.

An application solution for an intermediate layer is prepared, and applied onto the conductive support. Thus, the intermediate layer according the present invention can be formed. The intermediate layer can also be formed as follows: a conductive layer is placed on the conductive support, and then, the application solution for an intermediate layer is applied onto the conductive layer in the same manner as above. The application solution for an intermediate layer is prepared by the following method.

In the method for preparing the application solution for an intermediate layer, first, the compound having the structure represented by the formula (1) and the metal-oxide particles are dispersed to prepare a metal-oxide particle dispersing solution. Subsequently, a resin and the metal-oxide particle dispersing solution are dissolved or dispersed in a solvent to prepare an application solution for an intermediate layer. Alternatively, the compound having the structure represented by the formula (1), the metal-oxide particle, and the resin may be simultaneously dispersed in a solvent to prepare an application solution for an intermediate layer.

Examples of the dispersion method include methods using a paint shaker, a homogenizer, an ultrasonic dispersing machine, a bead mill, a ball mill, a sand mill, a roll mill, a vibration mill, an Attritor, a homomixer, and a liquid collision type high-speed dispersing machine.

Examples of the solvent used for the application solution for an intermediate layer include benzene, toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, dioxane, methylal, tetrahydrofuran, methanol, ethanol, propanol, isopropyl alcohol, butyl alcohol, 2-methoxyethanol, methoxypropanol, dimethylformamide, dimethylacetamide, dimethyl sulfoxide, and water. Among them, preferred are ethyl acetate, acetone, methyl ethyl ketone, cyclohexanone, dioxane, methylal, tetrahydrofuran, methanol, ethanol, isopropyl alcohol, butyl alcohol, methoxypropanol, and water.

The total mass of the compound having the structure represented by the formula (1) and the metal-oxide particle in the present invention is preferably 0.5 parts by mass or more and 28 parts by mass or less, more preferably 1.6 parts by mass or more and 28 parts by mass or less based on 1 part by mass of the resin. Moreover, because the specific gravity depends on the kind of metal-oxide particles, a preferred proportion depends on each metal-oxide particle. In the case of tin oxide, tin oxide is preferably 1.7 parts by mass or more and 28 parts by mass or less, more preferably 4.6 parts by mass or more and 28 parts by mass or less based on 1 part by mass of the resin. In the case of titanium oxide, titanium oxide is preferably 1 part by mass or more and 16 parts by mass or less, more preferably 2.6 parts by mass or more and 16 parts by mass or less based on 1 part by mass of the resin. In the case of zinc oxide, zinc oxide is preferably 1.5 parts by mass or more and 24 parts by mass or less, more preferably 4 parts by mass or more and 24 parts by mass or less based on 1 part by mass of the resin. In the case of aluminum oxide, aluminum oxide is preferably 0.7 parts by mass or more and 11 parts by mass or less, more preferably 1.8 parts by mass or more and 11 parts by mass or less based on 1 part by mass of the resin.

The film thickness of the intermediate layer is preferably 0.01 μm or more and 40 μm or less, and more preferably 0.1 to 5 μm. In the present invention, preferably, the intermediate layer includes no hole-transporting substance.

(Conductive Support)

Examples of the conductive support used for the present invention include metals such as aluminum, nickel, copper, gold, iron, and stainless steel or alloys. Examples of the conductive support include those obtained by placing thin film of a metal such as aluminum, silver, and gold or a thin film of a conductive material such as indium oxide and tin oxide on an insulative support of a material such as polyester, polycarbonate, and glass; and those provided with a conductive layer having carbon or a conductive filler dispersed in a resin. The conductive support to be used has a cylindrical or film-like shape.

In the case where the electrophotographic photosensitive member according the present invention is used for a printer using laser light with a single wavelength, preferably, the surface of the conductive support is roughened properly in order to suppress interference fringes. Specifically, the conductive support having a surface subjected to a treatment such as honing, blasting, machining, and electropolishing, or a conductive support of aluminum or an aluminum alloy having a conductive layer thereon is preferably used. Interference fringes are produced on an output image by interference of the light reflected on the surface of the conductive layer. In order to suppress such interference fringes, a surface roughening material for roughening the surface of the conductive layer can also be added to the conductive layer.

In a method for placing a conductive layer having a conductive fine particle and a resin on a conductive support, the conductive layer includes powder containing the conductive fine particle. As the conductive fine particle, titanium oxide and barium sulfate are used, for example. When necessary, a conductive coating layer of tin oxide, for example, is provided on the conductive fine particle to form a filler having a proper resistivity. The conductive fine particle powder preferably has a resistivity of 0.1 to 1000 Ω·cm, and more preferably has that of 1 to 1000 Ω·cm. The content of the filler is preferably 1.0 to 90% by mass, and more preferably 5.0 to 80% by mass based on the total mass of the conductive layer.

Examples of the resin used for the conductive layer include phenol resins, polyurethane resins, polyimide resins, polyamide resins, polyamidimide resins, polyamic acid, polyvinyl acetal resins, epoxy resins, acrylic resins, melamine resins, and polyester resins. These resins may be used alone or in combination. Use of these resins provides high adhesiveness to the conductive support, improves dispersibility of the filler, and provides high resistance against a solvent after film formation. Among the resins above, particularly preferred are phenol resins, polyurethane resins, and polyamic acid.

A surface roughening material may be used for the conductive layer in order to improve an effect of preventing interference fringes caused by diffuse reflection by laser light. As the surface roughening material, resin particles having an average particle size of 1 to 6 μm are preferred. Specifically, examples thereof include particles of curable rubbers and curable resins such as polyurethane resins, epoxy resins, alkyd resins, phenol resins, polyester resins, silicone resins, and acryl-melamine resins. Among them, preferred are particles of silicone resins that hardly aggregate. Moreover, in order to enhance the surface properties of the conductive layer, a known leveling agent may be added.

The conductive layer can be formed by immersion coating or coating of a solvent by a Meyer bar. The film thickness of the conductive layer is preferably 0.1 to 35 μm, and more preferably 5 to 30 μm.

(Charge-Generating Layer)

Examples of the charge-generating substance used for the charge-generating layer of the electrophotographic photosensitive member according to the present invention include azo pigments, phthalocyanine pigments, indigo pigments, perylene pigments, polycyclic quinone pigments, squarylium dyes, pyrylium salts, thiapyrylium salts, triphenylmethane dyes, inorganic substances, quinacridone pigments, azulenium salt pigments, cyanine dyes, anthanthrone pigments, pyranthrone pigments, xanthene dyes, quinoneimine dyes, and styryl dyes.

Examples of the phthalocyanine pigments include nonmetallic phthalocyanine, oxytitanyl phthalocyanine, hydroxygallium phthalocyanine, and halogenated gallium phthalocyanine such as chlorogallium phthalocyanine. These charge-generating substances may be used alone or in combination.

Examples of resins used for the charge-generating layer include acrylic resins, allyl resins, alkyd resins, epoxy resins, diallyl phthalate resins, silicone resins, styrene-butadiene copolymers, phenol resins, butyral resins, benzal resins, polyacrylate resins, polyacetal resins, polyamidimide resins, polyamide resins, polyarylether resins, polyarylate resins, polyimide resins, polyurethane resins, polyester resins, polyethylene resins, polycarbonate resins, polystyrene resins, polysulfone resins, polyvinyl acetal resins, polybutadiene resins, polypropylene resins, methacrylic resins, urea resins, vinyl chloride-vinyl acetate copolymers, vinyl acetate resins, and vinyl chloride resins. Among them, butyral resins are particularly preferred. These resins can be used alone, or two or more thereof can be mixed or used as a copolymer.

The charge-generating layer can be formed as follows: an application solution for a charge-generating layer obtained by dispersing the charge-generating substance, the resin, and a solvent is applied, and dried. Examples of a dispersion method include methods using a paint shaker, a homogenizer, an ultrasonic dispersing machine, a bead mill, a ball mill, a sand mill, a roll mill, a vibration mill, an Attritor, a homomixer, and a liquid collision type high-speed dispersing machine. The proportion of the resin to the charge-generating substance is preferably 0.3 parts by mass or more and 4 parts by mass or less based on 1 part by mass of the charge-generating substance.

The film thickness of the charge-generating layer is preferably 0.01 to 5 μm, and particularly preferably 0.1 to 2 μm. A variety of sensitizers, antioxidants, ultraviolet absorbing agents, and plasticizers can also be added to the charge-generating layer when necessary.

(Hole-Transporting Layer)

Examples of the hole-transporting substance used for the hole-transporting layer of the electrophotographic photosensitive member according to the present invention include triarylamine compounds, hydrazone compounds, stilbene compounds, pyrazoline compounds, oxazole compounds, triallylmethane compounds, and thiazole compounds. In the present invention, the hole-transporting layer preferably includes a hole-transporting substance such as triarylamine compounds, hydrazone compounds, and stilbene compounds.

Examples of the resin used for the hole-transporting layer include polyester resins, polycarbonate resins, polymethacrylic ester, polyarylate resins, polysulfone resins, and polystyrene resins. Among these, particularly preferred are polycarbonate resins and polyarylate resins.

The film thickness of the hole-transporting layer is preferably 5 to 40 μm, and particularly, more preferably 10 to 35 μm. The hole-transporting layer can also include an antioxidant, an ultraviolet absorbing agent, and a plasticizer when necessary. Moreover, the hole-transporting layer may include fluorine atom-containing resins and silicone-containing resins. The hole-transporting layer may also include particles composed of the resin, metal-oxide particles, and inorganic fine particles.

A protective layer may be provided on the photosensitive layer of the electrophotographic photosensitive member according to the present invention when necessary. The protective layer contains a resin such as polyvinyl butyral resins, polyester resins, polycarbonate resins, polyamide resins, polyimide resins, polyarylate resins, polyurethane resins, phenol resins, styrene-butadiene copolymers, ethylene-acrylic acid copolymers, or styrene-acrylonitrile copolymers. The protective layer is formed by dissolving these resins in an appropriate organic solvent, applying the solution onto the photosensitive layer, and drying the applied solution. The film thickness of the protective layer is preferably 0.05 to 20 μm. The protective layer may also include a conductive particle and an ultraviolet absorbing agent.

When the application solution for each of the layers is applied, application methods such as application by immersion (immersion coating), spray coating, spin coating, roller coating, Meyer bar coating, and blade coating can be used.

(Electrophotographic Apparatus)

Figure 1:
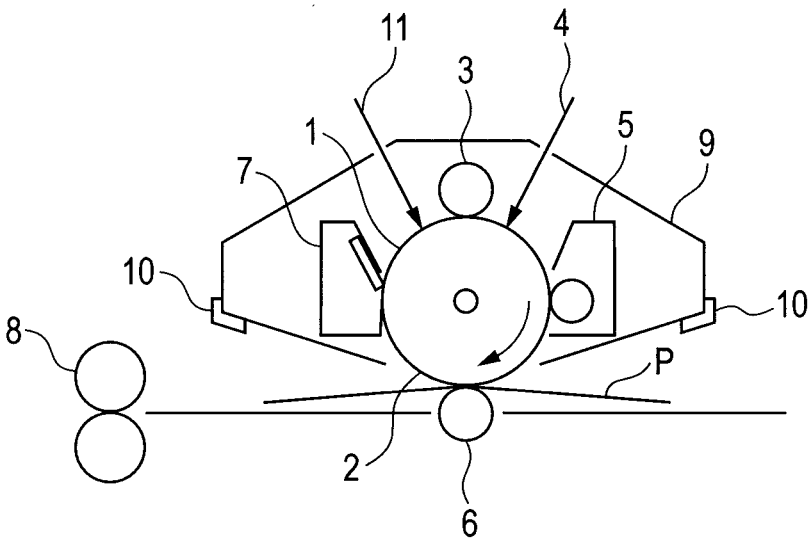
FIG. 1 is a drawing showing an example of a schematic configuration of an electrophotographic apparatus provided with a process cartridge having an electrophotographic photosensitive member according to the present invention.

Next, FIG. 1 shows a schematic configuration of an electrophotographic apparatus including the electrophotographic photosensitive member and process cartridge according to the present invention.

In FIG. 1, a cylindrical electrophotographic photosensitive member 1 is rotated and driven around a shaft 2 in the arrow direction at a predetermined circumferential speed. The surface of the electrophotographic photosensitive member 1 is uniformly charged at a predetermined negative potential by a charging device 3 in a rotation process. Next, the surface of the electrophotographic photosensitive member 1 receives exposure light (image exposure light) 4 having an intensity modulated according to a chronological electric digital image signal of target image information output from an exposing device (not illustrated) using slit exposure by reflection light from an original or laser beam scanning exposure. Thus, an electrostatic latent image is sequentially formed on the surface of the electrophotographic photosensitive member 1 according to the target image information. The voltage applied to the charging device 3 may be one of a voltage in which an AC component is superimposed on a DC component and a voltage having only a DC component. In the present invention, a charging device that applies only the DC component is used.

The electrostatic latent image formed on the surface of the electrophotographic photosensitive member 1 is developed with a toner in a developer of a developing device 5 by reversal development to form a toner image. Then, the toner image formed and carried on the surface of the electrophotographic photosensitive member 1 is sequentially transferred onto a transfer material P by a transfer bias from a transferring device 6. The transfer material P is extracted from a transfer material feeding unit (not illustrated) in synchronization with rotation of the electrophotographic photosensitive member 1, and fed to between the electrophotographic photosensitive member 1 and the transferring device 6 (contact portion). A bias voltage having a polarity opposite to that of the charge of the toner is applied to the transferring device 6 from a bias power supply (not illustrated).

The transfer material P having the transferred toner image is separated from the surface of the electrophotographic photosensitive member 1, and conveyed to a fixing unit 8 to be subjected to fixing of the toner image. Thereby, the transfer material P is conveyed as an image-formed product (print, copy) to the outside of the apparatus.

The surface of the electrophotographic photosensitive member 1 after transfer of the toner image is cleaned by removing a transfer residual developer (transfer residual toner) by a cleaning device 7. Further, the surface of the electrophotographic photosensitive member 1 is discharged by the exposure light 11 from the exposing device (not illustrated), and then repeatedly used for formation of an image. An intermediate transfer type transferring device may be used in which a belt-like or drum-like intermediate transfer member is used as the transferring device.

In the present invention, a plurality of components may be selected from the electrophotographic photosensitive member 1, the charging device 3, the developing device 5, and the cleaning device 7, and accommodated in a container to be integrally supported as a process cartridge. Moreover, it may be configured such that the process cartridge may be detachably attached to the main body of the electrophotographic apparatus such as a copier and a laser beam printer. For example, the electrophotographic photosensitive member 1, the charging device 3, the developing device 5, and the cleaning device 7 are integrally supported to form a cartridge. Then, the process cartridge 9 can be detachably attached to the main body of the electrophotographic apparatus using a guiding unit 10 such as a rail in the main body of the electrophotographic apparatus.

EXAMPLES

Hereinafter, the present invention will be described more in detail using Examples and Comparative Examples. Note that the present invention will not be limited to Examples below.

The compound having the structure represented by the formula (1) used in the present invention can be synthesized as described in a known example (J. Chem. Soc., Perkin Tans. 2, 2001, pp. 1045-1050 and Chem. Eur. J. 2006, 12, pp. 4241-4248). A compound made by Sigma-Aldrich Corporation such as 2,2':6',2"-Terpyridine can also be used.

Example 1

As a conductive support, an aluminum cylinder having a length of 257 mm and a diameter of 24 mm (JIS-A3003, aluminum alloy) was prepared.

Next, 50 parts by mass of titanium oxide particles coated with oxygen-deficient tin oxide (powder resistivity of 120 Ω·cm, coating ratio of $SnO_2$ (mass ratio) of 40%), 40 parts by mass of a phenol resin (trade name: Plyophen J-325, made by DIC Corporation, solid content of the resin of 60%), and 40 parts by mass of methoxypropanol were dispersed for 3 hours by a sand mill using glass beads with a diameter of 1 mm to prepare an application solution for a conductive layer. The application solution for a conductive layer was applied by immersion onto the aluminum cylinder, and thermally cured at 145° C. for 30 minutes to form a conductive layer having a film thickness of 15 μm. The number average particle size of the titanium oxide particle coated with oxygen-deficient tin oxide in the application solution for a conductive layer was measured using a particle size distribution analyzer CAPA700 made by HORIBA, Ltd. Using a tetrahydrofuran (THF) was used as a disperse medium, measurement was performed at the number of rotation of 5000 rpm by centrifugation. The number average particle size of the titanium oxide particle was 0.32 μm.

Next, 2.1 parts by mass of an exemplified compound T-1 (2,2':6',2"-Terpyridine, made by Sigma-Aldrich Corporation) and 21 parts by mass of a tin oxide particle having a number average particle size of 10 nm (density of 7.0 g/cm$^3$) were placed into 186.9 parts by mass of methanol. The solution was dispersed for 16 hours by a paint shaker using glass beads with a diameter of 1 mm to prepare a metal-oxide particle dispersing solution.

A polyolefin resin used for the intermediate layer of the electrophotographic photosensitive member according to the present invention is synthesized by the following method. Synthesis of the polyolefin resin is performed by a method described in Chapter 4 of "Shin koubunshi Jikkengaku 2: koubunshi no Gousei Hannou (1) (New Polymer Experimental Study 2: Synthesis and reaction of Polymer (1))" (Kyoritsu Shuppan Co., Ltd), and Japanese Patent Application Laid-Open No. 2003-105145 and Japanese Patent Application Laid-Open No. 2003-147028.

Using a sealable stirrer having a heater and a 1-L pressure-resistive glass container, stirring was performed as follows. Into the glass container, 80.0 parts by mass of a polyolefin resin (trade name: Bondine HX8290, made by Sumitomo Chemical Co., Ltd.), 30.0 parts by mass of ethanol, 3.9 parts by mass of N,N-dimethylethanolamine, and 206.1 parts by mass of distilled water were placed. Stirring was performed at a rotational speed of a stirring blade of 300 rpm. It was found that the resin particles were not precipitated at the bottom of the glass container, but floated. Then, while this floating state was kept, the power supply of the heater was turned on after 10 minutes for heating. The temperature within the system was kept at 140° C., followed by stirring for 20 minutes. Subsequently, the glass container was placed into a water bath, and cooled to room temperature (approximately 25° C.) while stirring was performed at a rotational speed of 300 rpm. The mixture was filtered under pressure (air pressure of 0.2 MPa) with a 300-mesh filter of stainless steel (wire diameter of 0.035 mm, plain-woven) to obtain an opaque white uniform polyolefin resin aqueous dispersion with a solid content of 25% (viscosity-average molecular weight 27,000 to 28,000).

4 parts by mass of the polyolefin resin aqueous dispersion and 210 parts by mass of the metal-oxide particle dispersing solution were sufficiently stirred within the container to prepare an application solution for an intermediate layer used for the electrophotographic photosensitive member. Next, the application solution for an intermediate layer was applied by immersion onto the conductive layer, and dried at 120° C. for 10 minutes to form an intermediate layer having a film thickness of 1 μm.

Next, 10 parts by mass of hydroxy gallium phthalocyanine crystals in a crystal form having an intense peak at Bragg angles (2θ±0.2° of 7.5°, 9.9°, 16.3°, 18.6°, 25.1° and 28.3° in CuKα characteristic X ray diffraction were prepared. 5 parts by mass of a polyvinyl butyral resin (S-LEC BX-1, made by Sekisui Chemical Co., Ltd.) and 260 parts by mass of cyclohexanone were mixed with the hydroxy gallium phthalocyanine crystals, and dispersed for 1.5 hours using a sand mill having glass beads with a diameter of 1 mm. After dispersion, 240 parts by mass of ethyl acetate was added to prepare an application solution for a charge-generating layer. The application solution for a charge-generating layer was applied by immersion onto the intermediate layer, and dried at 100° C. for 10 minutes to form a charge-generating layer having a film thickness of 0.17 μm.

Next, 6 parts by mass of an amine compound having a structure represented by the following formula (4), 2 parts by mass of an amine compound having a structure represented by the following formula (5), and 10 parts by mass of a polyarylate resin having a repeating structure unit represented by the following formula (6) (weight-average molecular weight Mw of 100,000) were dissolved in a solvent composed of monochlorobenzene and dimethoxymethane at a final weight ratio of 7:3 to prepare an application solution for a hole-transporting layer. The weight-average molecular weight (Mw) of the polyarylate resin was measured by a gel permeation chromatography "HLC-8120GPC" made by Tosoh Corporation, and calculated in terms of polystyrene. In the polyarylate resin having the structure represented by the formula (6), the ratio of isophthalic acid/terephthalic acid is 1/1.

(4)

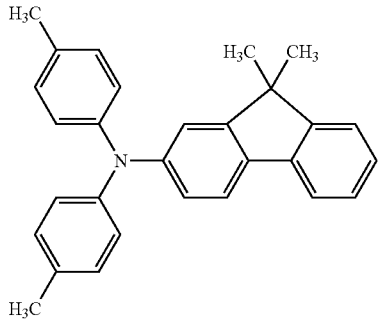

(5)

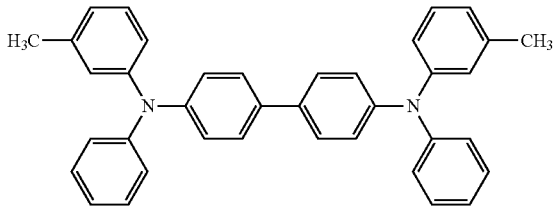

(6)

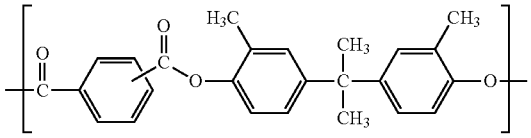

The application solution for a hole-transporting layer was applied by immersion onto the charge-generating layer, and dried at 120° C. for 1 hour to form a hole-transporting layer having a film thickness of 16 μm. Thus, an electrophotographic photosensitive member of Example 1 having the conductive layer, the intermediate layer, the charge-generating layer and the hole-transporting layer was produced.

Examples 2 to 22

An electrophotographic photosensitive member was produced in the same manner as in Example 1 except that the compound having the structure represented by the formula (1) in the application solution for an intermediate layer and the kinds and contents of the metal-oxide particle and solvent in Example 1 were changed as shown in Tables 4 and 5, and evaluated. The kinds of the exemplified compounds used were T-2 (4'-chloro-2,2':6',2"-Terpyridine, made by Sigma-Aldrich Corporation), T-3 (6,6"-Dibromo-2,2':6',2"-Terpyridine, made by Sigma-Aldrich Corporation), T-4 (4,4',4"-Tri-tert-Butyl-2,2':6',2"-Terpyridine, made by Sigma-Aldrich Corporation), T-5 (4'-(4-Chlorophenyl)-2,2':6',2"-Terpyridine, made by Sigma-Aldrich Corporation), T-6 (4'-(4-Methylphenyl)-2,2':6',2"-Terpyridine, made by Sigma-Aldrich Corporation), T-7 (Trimethyl 2,2':6',2"-Terpyridine-4,4',4"-tricarboxylate, made by Sigma-Aldrich Corporation), and T-8 (4',4"-(1,4-phenylene)bis(2,2':6',2"-Terpyridine, made by Sigma-Aldrich Corporation). T-9 was synthesized using 2,2':6',2"-Terpyridine (made by Tokyo Chemical Industry Co., Ltd.) and acetyl chloride (made by Tokyo Chemical Industry Co., Ltd.) with reference to the description of a document (Catalysis Communications 6(12), 2005, pp. 753-756). The kinds of the metal-oxide particles used were a titanium oxide particle (MT-100HD, made by Tayca Corporation, number average particle size of 15 nm), a zinc oxide particle (Mz-500, made by Tayca Corporation, number average particle size of 30 nm), an aluminum oxide particle (number average particle size of 35 nm), a zirconium oxide particle (number average particle size of 100 nm), and an indium oxide particle (number average particle size of 50 nm).

Example 23

An electrophotographic photosensitive member was produced in the same manner as in Example 1 except that the application solution for an intermediate layer in Example 1 was changed as follows, and evaluated. The application solution for an intermediate layer was prepared as follows: 1 part by mass of a polyamide resin (AMILAN CM8000, made by Toray Industries, Inc.), 2.1 parts by mass of the exemplified compound T-1 compound, 18.9 parts by mass of the tin oxide particle having a number average particle size of 10 nm (density of 7.0 g/cm$^3$), 146 parts by mass of butanol, and 294 parts by mass of methanol were dispersed for 10 hours by a paint shaker using glass beads with a diameter of 1 mm.

Example 24

An electrophotographic photosensitive member was produced in the same manner as in Example 1 except that the application solution for an intermediate layer in Example 1 was changed as follows, and the drying temperature and drying period after application by immersion was changed to 150° C. and 20 minutes, and evaluated. The application solution for an intermediate layer was prepared as follows: 0.6 parts by mass of an alkyd resin (BECKOLITE M-6401-50, made by DIC Corporation), 0.4 parts by mass of a melamine resin (SUPER BECKAMINE G-821-60, made by DIC Corporation), 2.1 parts by mass of an exemplified compound T-1 compound, 18.9 parts by mass of a tin oxide particle having a number average particle size of 10 nm (density of 7.0 g/cm$^3$), and 440 parts by mass of 2-butanone were dispersed for 12 hours by a paint shaker using glass beads with a diameter of 1 mm.

Example 25

An electrophotographic photosensitive member was produced in the same manner as in Example 1 except that the application solution for an intermediate layer in Example 1 was changed as follows, the drying temperature and drying period after application by immersion was changed to 170° C. and 20 minutes, and evaluated. The application solution for an intermediate layer was prepared as follows: 0.57 parts by mass of a blocked isocyanate (Sumidur 3173, made by Sumika Bayer Urethane Co., Ltd.), 0.43 parts by mass of a butyral resin (BM-1, made by Sekisui Chemical Co., Ltd.), 2.1 parts by mass of the exemplified compound T-1 compound, 18.9 parts by mass of the tin oxide particle having a number average particle size of 10 nm (density of 7.0 g/cm$^3$), 352 parts by mass of 2-butanone, and 88 parts by mass of n-hexane were dispersed for 12 hours by a paint shaker using glass beads with a diameter of 1 mm. As a catalyst, 0.005 parts by mass of dioctyl laurate was added to 100 parts by mass of the dispersion liquid to prepare an application solution for an intermediate layer.

Comparative Example 1

An electrophotographic photosensitive member was produced in the same manner as in Example 1 except that the application solution for an intermediate layer in Example 1 was changed as follows, and evaluated. The application solution for an intermediate layer was prepared as follows: 2.1 parts by mass of the exemplified compound T-1 compound was added to 207.9 parts by mass of methanol, and dispersed for 16 hours by a paint shaker using glass beads with a diameter of 1 mm without a metal-oxide particle to prepare a dispersion liquid. 4 parts by mass of the polyolefin resin aqueous dispersion and 210 parts by mass of the dispersion liquid were sufficiently stirred within the container to prepare an application solution for an intermediate layer used for the electrophotographic photosensitive member.

Comparative Example 2

An electrophotographic photosensitive member was produced in the same manner as in Example 1 except that the exemplified compound T-1 was replaced by the comparative compound represented by the following formula (7), and evaluated.

(7)

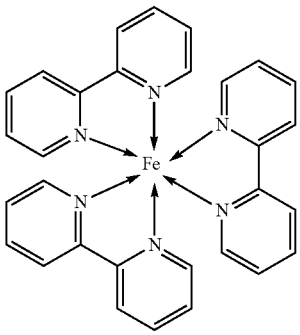

Comparative Example 3

An electrophotographic photosensitive member was produced in the same manner as in Example 1 except that the exemplified compound T-1 was replaced by the comparative compound represented by the following formula (8), and evaluated.

(8)

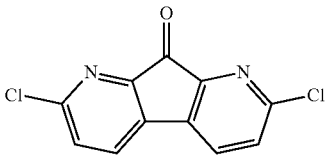

Comparative Example 4

An electrophotographic photosensitive member was produced in the same manner as in Example 1 except that the exemplified compound T-1 was replaced by the comparative compound represented by the following formula (9), and evaluated.

(9)

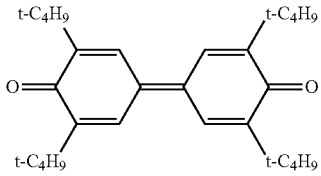

Comparative Example 5

An electrophotographic photosensitive member was produced in the same manner as in Example 1 except that the application solution for an intermediate layer in Example 1 was changed as follows, and evaluated. The application solution for an intermediate layer was prepared as follows: without the exemplified compound T-1 compound, 21 parts by mass of the tin oxide particle having a number average particle size of 10 nm (density of 7.0 g/cm$^3$) was added to 189 parts by mass of methanol, and dispersed for 16 hours by a paint shaker using glass beads with a diameter of 1 mm to prepare a metal-oxide particle dispersing solution. 4 parts by mass of the polyolefin resin aqueous dispersion and 210 parts by mass of the metal-oxide particle dispersing solution were sufficiently stirred within the container to prepare an application solution for an intermediate layer used for the electrophotographic photosensitive member.

Comparative Example 6

An electrophotographic photosensitive member was produced in the same manner as in Example 1 except that the application solution for an intermediate layer in Example 1 was changed as follows, and evaluated. The application solution for an intermediate layer was prepared as follows: without the exemplified compound T-1, 17 parts by mass of the zinc oxide particle (Mz-500, made by Tayca Corporation) was added to 153 parts by mass of methanol, and dispersed for 16 hours by a paint shaker using glass beads with a diameter of 1 mm to prepare a metal-oxide particle dispersing solution. 4 parts by mass of the polyolefin resin aqueous dispersion and 170 parts by mass of the metal-oxide particle dispersing solution were sufficiently stirred within the container to prepare an application solution for an intermediate layer used for the electrophotographic photosensitive member.

Comparative Example 7

An electrophotographic photosensitive member was produced in the same manner as in Example 1 except that the application solution for an intermediate layer in Example 1 was changed as follows, and evaluated. The application solution for an intermediate layer was prepared as follows: 5 parts by mass of γ-mercaptopropyltrimethoxysilane (TSL8380, made by Momentive Performance Materials Japan LLC) was mixed by a ball mill based on 100 parts by mass of rutile white titanium oxide having an average primary particle size of 40 nm (TTO55N, made by Ishihara Sangyo Kaisha, Ltd.) to prepare a dispersion liquid. The obtained dispersion liquid was fired at 120° C. for 1 hour to produce surface-treated titanium oxide. Next, 100 parts by mass of the surface-treated titanium oxide was dispersed in a mixed solvent of 140 parts by mass of methanol and 60 parts by mass of 1-propanol by a ball mill to obtain a γ-mercaptopropyltrimethoxysilane-treated titanium oxide dispersion liquid having a concentration of the solid content of 33.3%. 36 parts by mass of the dispersion liquid and 4 parts by mass of the polyolefin resin aqueous dispersion were sufficiently stirred within the container to prepare an application solution for an intermediate layer used for an electrophotographic photosensitive member.

TABLE 4

Composition of application solution for intermediate layer

| | | Examples | | | | | | | | | | | | | | |
|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 |
| Exemplified compound | T-1 | 2.1 | 1.4 | 0.7 | 1.05 | 0.21 | 0.105 | 0.021 | 5.25 | 6.3 | | | | | | |
| | T-2 | | | | | | | | | | 2.1 | | | | | |
| | T-3 | | | | | | | | | | | 2.1 | | | | |
| | T-4 | | | | | | | | | | | | 2.1 | | | |
| | T-5 | | | | | | | | | | | | | 2.1 | | |
| | T-6 | | | | | | | | | | | | | | 2.1 | |
| | T-7 | | | | | | | | | | | | | | | 2.1 |
| | T-8 | | | | | | | | | | | | | | | |
| | T-9 | | | | | | | | | | | | | | | |
| Comparative compound | Formula (7) | | | | | | | | | | | | | | | |
| | Formula (8) | | | | | | | | | | | | | | | |
| | Formula (9) | | | | | | | | | | | | | | | |
| Metal oxide | Tin oxide | 21.0 | 14.0 | 7.0 | 21.0 | 21.0 | 21.0 | 21.0 | 21.0 | 21.0 | 21.0 | 21.0 | 21.0 | 21.0 | 21.0 | 21.0 |
| | Titanium oxide | | | | | | | | | | | | | | | |
| | Zinc oxide | | | | | | | | | | | | | | | |
| | Zirconium oxide | | | | | | | | | | | | | | | |
| | Aluminum oxide | | | | | | | | | | | | | | | |
| | Indium oxide | | | | | | | | | | | | | | | |
| Binder resin | Polyolefin resin aqueous dispersion | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 |
| | Polyamide resin | | | | | | | | | | | | | | | |
| | Alkyd melamine resin | | | | | | | | | | | | | | | |
| | Urethane resin | | | | | | | | | | | | | | | |
| Solvent | Methanol | 186.9 | 124.6 | 62.3 | 188.0 | 188.8 | 188.9 | 188.9 | 183.8 | 182.7 | 186.9 | 186.9 | 186.9 | 186.9 | 186.9 | 186.9 |
| | Butanol | | | | | | | | | | | | | | | |
| | 2-Butanone | | | | | | | | | | | | | | | |
| | n-Hexane | | | | | | | | | | | | | | | |
| Application solution for intermediate layer | Total | 214 | 144 | 74 | 214 | 214 | 214 | 214 | 214 | 214 | 214 | 214 | 214 | 214 | 214 | 214 |
| Content of exemplified compound (parts by mass) | | 2.1 | 1.4 | 0.7 | 1.05 | 0.21 | 0.105 | 0.021 | 5.25 | 6.3 | 2.1 | 2.1 | 2.1 | 2.1 | 2.1 | 2.1 |
| Content of metal oxide (parts by mass) | | 21.0 | 14.0 | 7.0 | 21.0 | 21.0 | 21.0 | 21.0 | 21.0 | 21.0 | 21.0 | 21.0 | 21.0 | 21.0 | 21.0 | 21.0 |
| Proportion of contained exemplified compound to metal oxide [%] | | 10 | 10 | 10 | 5 | 1 | 0.5 | 0.1 | 25 | 30 | 10 | 10 | 10 | 10 | 10 | 10 |

TABLE 5

Composition of application solution for intermediate layer

| | | Examples | | | | | | | | | | Comparative Examples | | | | | |
|---|---|---|---|---|---|---|---|---|---|---|---|---|---|---|---|---|---|
| | | 16 | 17 | 18 | 19 | 20 | 21 | 22 | 23 | 24 | 25 | 1 | 2 | 3 | 4 | 5 | 6 |
| Exemplified compound | T-1 | | | 1.2 | 1.7 | 1.7 | 0.8 | 2.1 | 2.1 | 2.1 | 2.1 | 2.1 | | | | | |
| | T-2 | | | | | | | | | | | | | | | | |
| | T-3 | | | | | | | | | | | | | | | | |
| | T-4 | | | | | | | | | | | | | | | | |
| | T-5 | | | | | | | | | | | | | | | | |
| | T-6 | | | | | | | | | | | | | | | | |
| | T-7 | | | | | | | | | | | | | | | | |
| | T-8 | 2.1 | | | | | | | | | | | | | | | |
| | T-9 | | 2.1 | | | | | | | | | | | | | | |
| Comparative compound | Formula (7) | | | | | | | | | | | | 2.1 | | | | |
| | Formula (8) | | | | | | | | | | | | | 2.1 | | | |
| | Formula (9) | | | | | | | | | | | | | | 2.1 | | |

TABLE 5-continued

| Composition of application solution for intermediate layer | | | | | | | | | | | | | | | | | |
|---|---|---|---|---|---|---|---|---|---|---|---|---|---|---|---|---|---|
| | | Examples | | | | | | | | | | Comparative Examples | | | | | |
| | | 16 | 17 | 18 | 19 | 20 | 21 | 22 | 23 | 24 | 25 | 1 | 2 | 3 | 4 | 5 | 6 |
| Metal oxide | Tin oxide | 21.0 | 21.0 | | | | | | 18.9 | 18.9 | 18.9 | | 21.0 | 21.0 | 21.0 | 21.0 | |
| | Titanium oxide | | | 12.0 | | | | | | | | | | | | | 17.0 |
| | Zinc oxide | | | | 17.0 | | | | | | | | | | | | |
| | Zirconium oxide | | | | | 17.0 | | | | | | | | | | | |
| | Aluminum oxide | | | | | | 8.0 | | | | | | | | | | |
| | Indium oxide | | | | | | | 21.0 | | | | | | | | | |
| Binder resin | Polyolefin resin aqueous dispersion | 4.0 | 4.0 | 4.0 | 4.0 | 4.0 | 4.0 | 4.0 | | | | 4.0 | 4.0 | 4.0 | 4.0 | 4.0 | 4.0 |
| | Polyamide resin | | | | | | | | 1.0 | | | | | | | | |
| | Alkyd melamine resin | | | | | | | | | 1.0 | | | | | | | |
| | Urethane resin | | | | | | | | | | 1.0 | | | | | | |
| Solvent | Methanol | 186.9 | 186.9 | 106.8 | 151.3 | 151.3 | 71.2 | 186.9 | 294 | | | 207.9 | 186.9 | 186.9 | 186.9 | 189 | 153 |
| | Butanol | | | | | | | | 146 | | | | | | | | |
| | 2-Butanone | | | | | | | | | 440 | 352 | | | | | | |
| | n-Hexane | | | | | | | | | | 88 | | | | | | |
| Application solution for intermediate layer | Total | 214 | 214 | 124 | 174 | 174 | 84 | 214 | 462 | 462 | 462 | 214 | 214 | 214 | 214 | 214 | 174 |
| Content of exemplified compound (parts by mass) | | 2.1 | 2.1 | 1.2 | 1.7 | 1.7 | 0.8 | 2.1 | 2.1 | 2.1 | 2.1 | | | | | | |
| Content of metal oxide (parts by mass) | | 21.0 | 21.0 | 12.0 | 17.0 | 17.0 | 8.0 | 21.0 | 18.9 | 18.9 | 18.9 | | | | | | |
| Proportion of contained exemplified compound to metal oxide [%] | | 10 | 10 | 10 | 10 | 10 | 10 | 10 | 11 | 11 | 11 | | | | | | |

(Evaluation)

The electrophotographic photosensitive members of Examples 1 to 26 and Comparative Examples 1 to 6 were evaluated according to the following evaluation method.

Figure 3:
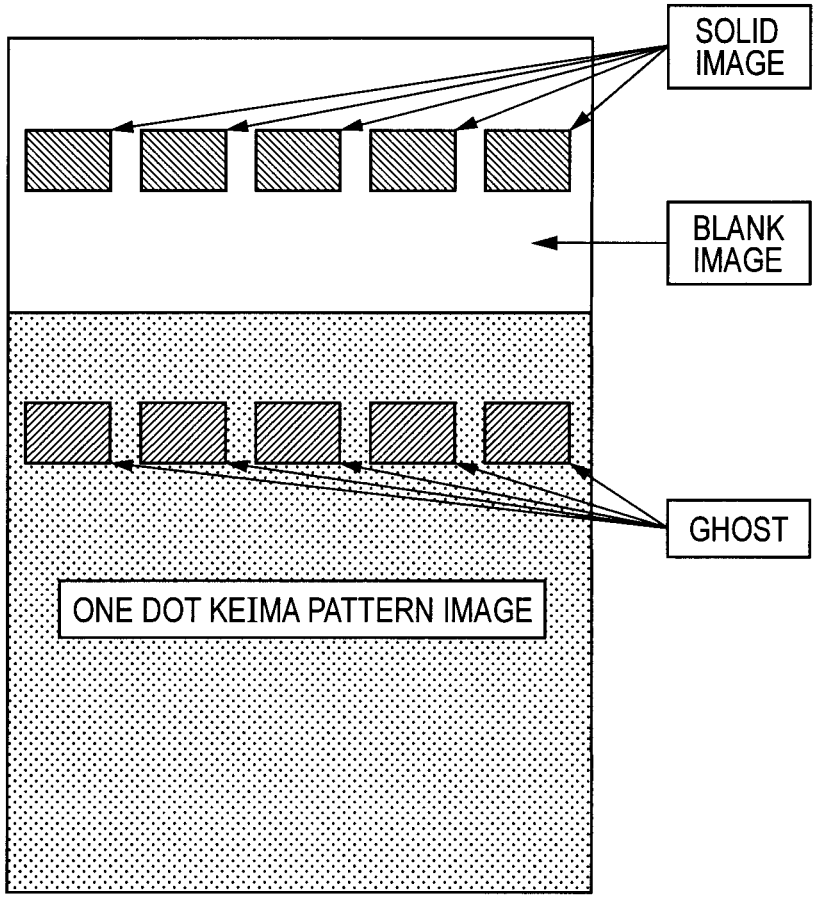
FIG. 3 is a drawing for illustrating printing for evaluating a ghost used for evaluation of a ghost image.
Figure 4:
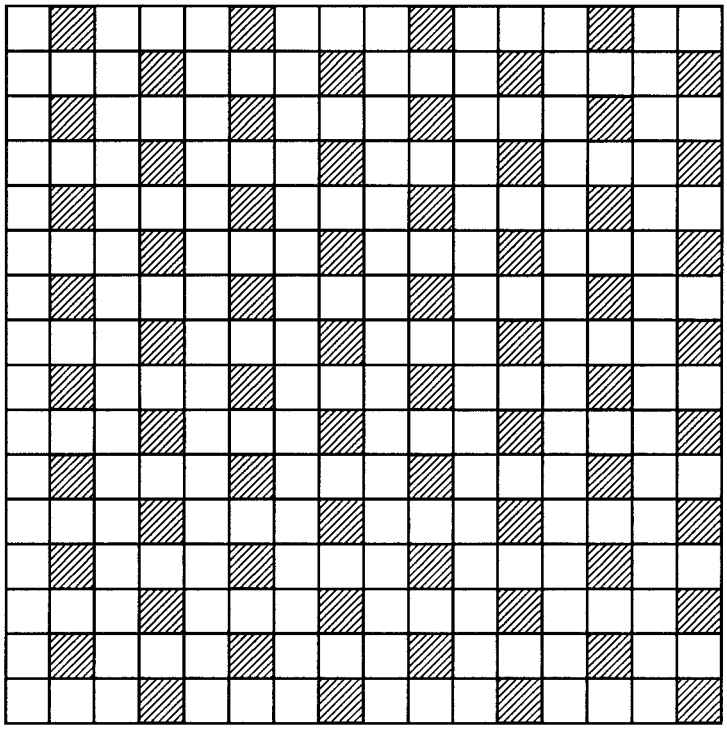
FIG. 4 is a drawing for illustrating an image pattern of a one dot KEIMA pattern.

As an evaluation apparatus, a laser beam printer LaserJet 3550 made by Hewlett-Packard Company was used. Under an environment of a temperature of 15° C. and a humidity of 10% RH, the produced electrophotographic photosensitive member was attached to a process cartridge for a cyan color. The process cartridge was attached to a station for a cyan process cartridge. After an image was output continuously 5000 sheets, the image was evaluated. The surface potential of the drum was set such that an initial dark portion potential might be −500 V, and an initial bright portion potential might be −170 V. The surface potential of the electrophotographic photosensitive member was measured as follows: the cartridge was modified, and a potential probe (model 6000 B-8, made by Trek Inc.) was attached to a developing position to measure the potential of the central portion of the drum using an electrostatic voltmeter (model 344, made by Trek Inc.). During feeding the sheets, a character image having a print ratio of 1% in each color was printed by full color print operation with a plain paper of an A4 size, and 5000 sheets of the image were output without using the exposure. At a time of starting the evaluation and at the time of ending printing of 5000 sheets, a solid blank image was output as a first copy. Five sheets of a print for evaluating a ghost were continuously output. (Rectangular solid image in the white (blank image) at the leading end of the image as shown in FIG. 3 was output. Then, a one dot KEIMA pattern halftone image shown in FIG. 4 was created. In FIG. 3, the portion designated by a "ghost" is a ghost portion for evaluating presence of the ghost attributed to the solid image. In the case where the ghost appears, the "ghost" appears as shown in FIG. 3). Next, one sheet of the solid image was output, and five sheets of a print for evaluating a ghost were output again. The one dot KEIMA pattern was shown in FIG. 4.

(Evaluation of Ghost Image)

In evaluation of the ghost image, the difference between the density of the one dot KEIMA pattern halftone image and that of the image in the ghost portion was measured using a spectrodensitometer X-Rite 504/508 (made by X-Rite, Incorporated) in the print for evaluating a ghost. One sheet of the print for evaluating a ghost was measured at 10 points, and the average of these 10 points was calculated as a result of the one sheet. The 10 sheets of the print for evaluating a ghost all were measured in the same manner. Then, the average value of the 10 points for each of the 10 sheets was determined. The difference between the density of the halftone image and the image of the ghost portion was defined as the density difference of the ghost image. A smaller difference in the density of the ghost image means better ghost properties. Evaluation was made according to the following criterion, and the obtained results were shown in Table 6. In the present invention, it was determined that in the evaluation criterion below, AA, A and B are a level such that the effect of the present invention is obtained; among them, A is excellent, and AA is particularly excellent. On the other hand, it was determined that C is a level such that the effect of the present invention is not obtained.

AA: density difference of the ghost image 0.020 or more and 0.024 or less

A: density difference of the ghost image 0.025 or more and 0.029 or less

B: density difference of the ghost image 0.030 or more and 0.034 or less

C: density difference of the ghost image 0.035 or more.

(Evaluation of Black Spots Image)

In evaluation of a black spots image, a solid blank image was output on a glossy paper, and the difference of the image density between the glossy paper having no printing and that having the solid blank image was measured using a reflection densitometer (DENSITOMETER TC-6DS, made by Tokyo Denshoku. Co., Ltd.). For the difference in the image density, 10 points were measured, and the average value was determined. As the difference of the image density between the glossy paper having no printing and that having the solid blank image is smaller, the amount of the black spots is smaller and the quality of the image is higher. Evaluation was made according to the following criterion, and the obtained results were shown in Table 6. In the present invention, it was determined that in the evaluation criterion below, A and B are a level such that the effect of the present invention is obtained; among them, A is excellent. On the other hand, it was determined that C is a level such that the effect of the present invention is not obtained.

A: difference of black spots image density 0 or more and 1.9 or less

B: difference of black spots image density 2.0 or more and 2.3 or less

C: difference of black spots image density 2.4 or more.

TABLE 6

| Evaluation results | | | | | |
|---|---|---|---|---|---|
| | | Ghost image density difference | | Black spots | |
| | | Evaluation | Numeric value | Evaluation | Numeric value |
| Examples | 1 | A | 0.025 | A | 1.7 |
| | 2 | A | 0.026 | A | 1.7 |
| | 3 | A | 0.028 | A | 1.7 |
| | 4 | AA | 0.024 | A | 1.9 |
| | 5 | AA | 0.023 | A | 1.9 |
| | 6 | AA | 0.021 | B | 2.1 |
| | 7 | AA | 0.024 | B | 2.1 |
| | 8 | A | 0.028 | A | 1.5 |
| | 9 | B | 0.031 | A | 1.5 |
| | 10 | A | 0.028 | A | 1.7 |
| | 11 | A | 0.027 | A | 1.7 |
| | 12 | A | 0.025 | A | 1.7 |
| | 13 | A | 0.028 | A | 1.7 |
| | 14 | A | 0.025 | A | 1.7 |
| | 15 | A | 0.026 | A | 1.7 |
| | 16 | A | 0.026 | A | 1.7 |
| | 17 | A | 0.027 | A | 1.7 |
| | 18 | A | 0.028 | A | 1.7 |
| | 19 | A | 0.029 | A | 1.7 |
| | 20 | B | 0.031 | B | 2.2 |
| | 21 | B | 0.030 | A | 1.7 |
| | 22 | A | 0.028 | A | 2.2 |
| | 23 | A | 0.026 | A | 2.2 |
| | 24 | A | 0.027 | A | 2.2 |
| | 25 | A | 0.028 | B | 2.2 |
| Comparative Examples | 1 | C | 0.045 | A | 1.9 |
| | 2 | C | 0.038 | C | 2.4 |
| | 3 | C | 0.039 | C | 2.4 |
| | 4 | C | 0.037 | C | 2.4 |
| | 5 | AA | 0.025 | C | 2.4 |
| | 6 | A | 0.027 | C | 2.6 |
| | 7 | C | 0.066 | B | 2.1 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-191210, filed Aug. 27, 2010, which is hereby incorporated by reference herein in its entirety.

What is claimed is:

1. An electrophotographic photosensitive member, comprising:

a conductive support;

an intermediate layer which is placed on the conductive support;

a photosensitive layer which is placed on the intermediate layer, and comprises a charge-generating substance and a hole-transporting substance, wherein the intermediate layer comprises a metal-oxide particle and a compound having a structure represented by the following formula (1):

(1)

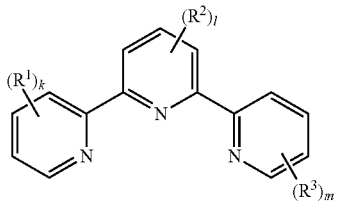

wherein, in the formula (1), $R^1$ and $R^3$ each independently represents a halogen atom, an alkyl group having 1 to 6 carbon atoms, an acetyl group, an alkyl halide group having 1 to 6 carbon atoms, or $COOR^4$, $R^4$ represents an alkyl group having 1 to 6 carbon atoms, k, l, and m each independently represents integer number 0 to 3, $R^2$ represents a halogen atom, an alkyl group having 1 to 6 carbon atoms, an acetyl group, an alkyl halide group having 1 to 6 carbon atoms, $COOR^8$, or an univalent group having a structure represented by the following formula (2) or the following formula (3), $R^8$ represents an alkyl group having 1 to 6 carbon atoms:

(2)

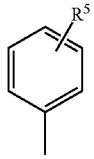

wherein, in the formula (2), $R^5$ represents a halogen atom, an alkyl group having 1 to 6 carbon atoms, an acetyl group, an alkyl halide group having 1 to 6 carbon atoms, or $COOR^9$, $R^9$ represents an alkyl group having 1 to 6 carbon atoms:

(3)

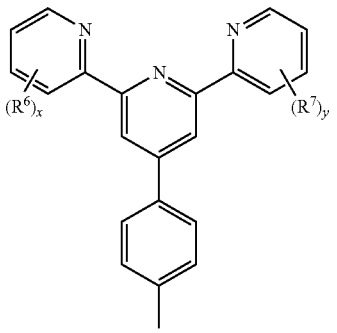

wherein, in the formula (3), $R^6$ and $R^7$ each independently represents a halogen atom, an alkyl group having 1 to 6 carbon atoms, an acetyl group, an alkyl halide group having 1 to 6 carbon atoms, or $COOR^{10}$, x and y each independently represents integer number 0 to 3, $R^{10}$ represents an alkyl group having 1 to 6 carbon atoms.

2. An electrophotographic photosensitive member according to claim 1, wherein the photosensitive layer comprises;

a charge-generating layer comprising the charge-generating substance and a hole-transporting layer which is placed on the charge-generating layer, and comprises the hole-transporting substance.

3. An electrophotographic photosensitive member according to claim 1, wherein the metal-oxide particle is a particle comprising at least one metal-oxide selected from the group consisting of tin-dioxide, titanium-dioxide and zinc-oxide.

4. A process cartridge detachably attachable to a main body of an electrophotographic apparatus, wherein the process cartridge integrally supports:

the electrophotographic photosensitive member according to claim 1; and at least one device selected from the group consisting of a charging device, a developing device, a transferring device, and a cleaning device.

5. An electrophotographic apparatus, comprising: the electrophotographic photosensitive member according to claim 1; a charging device; an exposing device; a developing device; and a transferring device.

6. An electrophotographic photosensitive member according to claim 1, wherein the content of the compound having a structure represented by the formula (1) is not less than 0.1% by mass and not more than 50% by mass based on the metal-oxide particles.

* * * * *